US011959185B2

(12) United States Patent
Cox et al.

(10) Patent No.: US 11,959,185 B2
(45) Date of Patent: Apr. 16, 2024

(54) TITANIUM MASTER ALLOY FOR TITANIUM-ALUMINUM BASED ALLOYS

(71) Applicant: UNIVERSAL ACHEMETAL TITANIUM, LLC, Cherry Hill, NJ (US)

(72) Inventors: James R. Cox, Butte, MT (US); Chanaka L. DeALWIS, Butte, MT (US); Benjamin A. Kohler, Butte, MT (US); Michael G. Lewis, Butte, MT (US); Juliane B. Kluck, Butte, MT (US)

(73) Assignee: UNIVERSAL ACHEMETAL TITANIUM, LLC, Cherry Hill, NJ (US)

( * ) Notice: Subject to any disclaimer, the term of this patent is extended or adjusted under 35 U.S.C. 154(b) by 0 days.

(21) Appl. No.: 17/856,594

(22) Filed: Jul. 1, 2022

(65) Prior Publication Data

US 2022/0349079 A1 Nov. 3, 2022

Related U.S. Application Data

(63) Continuation of application No. 15/872,328, filed on Jan. 16, 2018, now abandoned.

(60) Provisional application No. 62/446,205, filed on Jan. 13, 2017.

(51) Int. Cl.

| | |
|---|---|
| ***C25C 3/36*** | (2006.01) |
| ***C22C 14/00*** | (2006.01) |
| ***C25C 3/12*** | (2006.01) |
| ***C25C 3/28*** | (2006.01) |
| ***C25C 5/04*** | (2006.01) |
| ***C25C 7/00*** | (2006.01) |
| ***C25C 7/06*** | (2006.01) |

(52) U.S. Cl.

CPC ..... *C25C 3/36* (2013.01); *C22C 14/00* (2013.01); *C25C 3/12* (2013.01); *C25C 3/28* (2013.01); *C25C 5/04* (2013.01); *C25C 7/007* (2013.01); *C25C 7/06* (2013.01)

(58) Field of Classification Search

CPC .... C25C 3/36; C25C 3/28; C25C 5/04; C25C 1/24; C25C 1/22; C25C 3/24

See application file for complete search history.

(56) References Cited

U.S. PATENT DOCUMENTS

| | | | |
|---|---|---|---|
| 910,394 | A | 1/1909 | Kuhne |
| 1,089,773 | A | 3/1914 | Kraus |
| 1,533,505 | A | 4/1925 | Lubowsky |
| 1,562,041 | A | 11/1925 | Pacz |
| 1,593,660 | A | 7/1926 | Lubowsky |
| 2,148,345 | A | 2/1939 | Frendenberg |
| 2,205,854 | A | 6/1940 | Kroll |
| 2,337,314 | A | 12/1943 | Deppeler |
| 2,395,286 | A | 2/1946 | Merle |
| 2,647,826 | A | 8/1953 | Jordan |
| 2,684,653 | A | 7/1954 | Pryer |
| 2,707,679 | A | 5/1955 | Lilliendahl et al. |
| 2,714,564 | A | 8/1955 | Loonam |
| 2,745,802 | A | 5/1956 | Schmidt |
| 2,753,254 | A | 7/1956 | Rick |
| 2,757,135 | A | 7/1956 | Gleave et al. |
| 2,766,111 | A | 10/1956 | Singleton |
| 2,777,763 | A | 1/1957 | Whaley |
| 2,780,593 | A | 2/1957 | Snow et al. |
| 2,789,896 | A | 4/1957 | Coffer |
| 2,789,943 | A | 4/1957 | Kittelberger |
| 2,817,631 | A | 12/1957 | Gullett |
| 2,823,991 | A | 2/1958 | Kamlet |
| 2,830,893 | A | 4/1958 | Dean |
| 2,833,704 | A | 5/1958 | Wainer |
| 2,838,393 | A | 6/1958 | Dean |
| 2,846,303 | A | 8/1958 | Keller et al. |
| 2,846,304 | A | 8/1958 | Keller |
| 2,848,395 | A | 8/1958 | Carignan |
| 2,857,264 | A | 10/1958 | Schossberger |
| 2,864,749 | A | 12/1958 | Slatin |
| 2,876,094 | A | 3/1959 | Lusby, Jr. |
| 2,889,218 | A | 6/1959 | Hiskey et al. |
| 2,890,112 | A | 6/1959 | Winter, Jr. |
| 2,893,935 | A | 7/1959 | Johns |
| 2,901,410 | A | 8/1959 | Dean et al. |
| 2,904,428 | A | 9/1959 | Dean |
| 2,908,619 | A | 10/1959 | Barnett |

(Continued)

FOREIGN PATENT DOCUMENTS

| | | |
|---|---|---|
| AU | 2012358205 | 1/2018 |
| EP | 1541716 | 6/2005 |
| EP | 2794943 | 10/2014 |
| GB | 2158102 | 8/1988 |
| GB | 2472496 | 8/2010 |
| JP | 4813205 | 2/1973 |
| JP | 60238430 | 11/1985 |
| JP | 7165000423 | 6/1995 |
| JP | 8225980 | 9/1996 |
| JP | 201192748 | 7/2001 |
| JP | 2003524073 | 8/2003 |
| JP | 2003306725 | 10/2003 |
| JP | 2005194554 | 7/2005 |
| JP | 2009518544 | 5/2009 |
| JP | 201379446 | 5/2013 |
| JP | 2015-507696 A | 3/2015 |

(Continued)

OTHER PUBLICATIONS

Translation of EP-0803591-A1 (Year: 1997).*

(Continued)

*Primary Examiner* — Salil Jain

(74) *Attorney, Agent, or Firm* — Greenberg Traurig, LLP

(57) ABSTRACT

A process is disclosed for the electro-refinement of titanium aluminides to produce titanium-aluminum master alloys which process is effective even in the presence of substantial amounts of aluminum and in the presence of ten (10) or more weight percent oxygen in the material(s) to be refined. The process is likewise effective without the addition of titanium chlorides or other forms of soluble titanium to the electrolyte bath comprising halide salts of alkali metals or alkali-earth metals or a combination thereof.

11 Claims, No Drawings

(56) References Cited

U.S. PATENT DOCUMENTS

| | | | |
|---|---|---|---|
| 2,909,473 | A | 10/1959 | Dean |
| 2,929,473 | A | 10/1959 | Dean et al. |
| 2,913,378 | A | 11/1959 | Dean et al. |
| 2,913,380 | A | 11/1959 | Gullett |
| 2,915,382 | A | 12/1959 | Hellier et al. |
| 2,915,383 | A | 12/1959 | Yamartino |
| 2,917,440 | A | 12/1959 | Olson |
| 2,921,890 | A | 1/1960 | Raney |
| 2,922,710 | A | 1/1960 | Dombrowski et al. |
| 2,944,949 | A | 7/1960 | Leech |
| 2,951,021 | A | 8/1960 | Di Pietro |
| 2,986,462 | A | 5/1961 | Wright |
| 3,036,961 | A | 5/1962 | Herasymenko |
| 3,047,477 | A | 7/1962 | Spraul et al. |
| 3,085,872 | A | 4/1963 | Griffiths |
| 3,085,873 | A | 4/1963 | Griffiths |
| 3,098,021 | A | 7/1963 | Hansen |
| 3,098,805 | A | 7/1963 | Ervin, Jr. et al. |
| 3,114,626 | A | 12/1963 | Dombrowski et al. |
| 3,137,641 | A | 6/1964 | Slatin |
| 3,386,817 | A | 6/1968 | Huml |
| 3,406,056 | A | 10/1968 | Albert et al. |
| 3,625,676 | A | 12/1971 | Perfect |
| 3,721,549 | A | 3/1973 | Gallay et al. |
| 3,736,132 | A | 5/1973 | Prse et al. |
| 3,746,535 | A | 7/1973 | Brandstatter |
| 3,794,482 | A | 2/1974 | Anderson et al. |
| 3,801,307 | A | 4/1974 | Hurd |
| 3,825,415 | A | 7/1974 | Johnston et al. |
| 3,966,455 | A | 6/1976 | Taylor |
| 3,977,866 | A | 8/1976 | Othmer |
| 4,169,722 | A | 10/1979 | Fletcher |
| 4,390,365 | A | 6/1983 | Hard et al. |
| 4,396,472 | A | 8/1983 | Armand |
| 4,401,467 | A | 8/1983 | Jordan |
| 4,468,248 | A | 8/1984 | Megy |
| 4,725,312 | A | 2/1988 | Seon et al. |
| 4,770,750 | A | 9/1988 | Armand |
| 4,793,854 | A | 12/1988 | Shimotori et al. |
| 4,820,339 | A | 4/1989 | Bienvenu et al. |
| 4,875,985 | A | 10/1989 | Donahue et al. |
| 4,923,577 | A | 5/1990 | McLaughlin et al. |
| 4,964,973 | A | 10/1990 | Donahue et al. |
| 4,985,069 | A | 1/1991 | Traut |
| 4,999,097 | A | 3/1991 | Sadoway |
| 5,071,472 | A | 12/1991 | Traut et al. |
| 5,254,232 | A | 10/1993 | Sadoway |
| 5,397,375 | A | 3/1995 | O'Donnell et al. |
| 5,404,929 | A | 4/1995 | Till |
| 5,503,655 | A | 4/1996 | Joseph |
| 5,536,448 | A | 7/1996 | Takahashi et al. |
| 6,063,254 | A | 5/2000 | Rosenberg |
| 6,074,545 | A | 6/2000 | Ginatta |
| 6,103,303 | A | 8/2000 | Takahashi et al. |
| 6,117,208 | A | 9/2000 | Sharma |
| 6,136,706 | A | 10/2000 | Jabotinski et al. |
| 6,245,211 | B1 | 6/2001 | Fortin |
| 6,309,595 | B1 | 10/2001 | Rosenberg et al. |
| 6,596,228 | B2 | 7/2003 | Rosenberg et al. |
| 6,663,763 | B2 | 12/2003 | Strezov et al. |
| 6,712,952 | B1 | 3/2004 | Fray et al. |
| 6,799,344 | B2 | 10/2004 | Gladney et al. |
| 6,958,115 | B2 | 10/2005 | O'Gardy et al. |
| 7,208,075 | B2 | 4/2007 | Strezov et al. |
| 7,381,366 | B2 | 6/2008 | Carter, Jr. et al. |
| 7,410,562 | B2 | 8/2008 | Withers et al. |
| 7,470,355 | B2 | 12/2008 | Osborn et al. |
| 7,504,017 | B2 | 3/2009 | Cardarelli |
| 7,527,669 | B2 | 5/2009 | Morrell et al. |
| 7,624,464 | B2 | 12/2009 | Gladney et al. |
| 7,794,580 | B2 | 9/2010 | Withers et al. |
| 7,901,561 | B2 | 3/2011 | Johansen et al. |
| 7,985,326 | B2 | 7/2011 | Withers et al. |
| 8,127,383 | B2 | 3/2012 | Gladney et al. |
| 8,562,715 | B2 | 10/2013 | Gries |
| 9,816,192 | B2 | 11/2017 | Cox et al. |
| 10,066,308 | B2 | 9/2018 | Cox et al. |
| 2004/0068800 | A1 | 4/2004 | Gladney et al. |
| 2004/0159559 | A1 | 8/2004 | Fray et al. |
| 2005/0108826 | A1 | 5/2005 | Gladney et al. |
| 2005/0166706 | A1 | 8/2005 | Withers et al. |
| 2005/0279187 | A1 | 12/2005 | Shekhter |
| 2006/0049060 | A1 | 3/2006 | Hori |
| 2006/0236811 | A1 | 10/2006 | Withers et al. |
| 2006/0237327 | A1 | 10/2006 | Withers et al. |
| 2007/0029208 | A1 | 2/2007 | Withers et al. |
| 2007/0181435 | A1 | 8/2007 | Ogasawara et al. |
| 2007/0251833 | A1 | 11/2007 | Ratchev et al. |
| 2008/0149495 | A1 | 6/2008 | Mukunthan et al. |
| 2008/0187455 | A1 | 8/2008 | Armstrong et al. |
| 2008/0190778 | A1 | 8/2008 | Withers et al. |
| 2010/0132123 | A1 | 6/2010 | Gladney et al. |
| 2010/0237280 | A1 | 9/2010 | Barnes |
| 2010/0243468 | A1 | 9/2010 | Mu et al. |
| 2011/0097501 | A1 | 4/2011 | Hollins et al. |
| 2012/0152756 | A1 | 6/2012 | Fray et al. |
| 2013/0019717 | A1 | 1/2013 | Haidar |
| 2013/0164167 | A1* | 6/2013 | Cox ..... C22B 34/1277 204/243.1 |
| 2013/0180758 | A1* | 7/2013 | Holloway ..... H01B 1/023 174/128.1 |
| 2015/0075994 | A1* | 3/2015 | Tao ..... C01B 33/037 205/261 |
| 2018/0073101 | A1 | 3/2018 | Jones |
| 2018/0094357 | A1 | 4/2018 | Cox |
| 2019/0093202 | A1* | 3/2019 | Holloway ..... B22F 3/23 |

FOREIGN PATENT DOCUMENTS

| | | |
|---|---|---|
| JP | 6228550 | 10/2017 |
| JP | 2018-048402 | 3/2018 |
| JP | 6424265 | 10/2018 |
| RU | 2338805 | 5/2008 |
| RU | 2485194 | 6/2013 |
| RU | 2537676 | 10/2015 |
| SU | 419571 | 3/1974 |
| TW | 200523402 | 7/2005 |
| TW | 1564397 | 1/2017 |
| WO | 98/49370 | 11/1998 |
| WO | 2001/62996 | 8/2001 |
| WO | 2003/046258 | 6/2003 |
| WO | 2007/097823 | 8/2007 |
| WO | 2008/016526 | 2/2008 |
| WO | 2008/091806 | 7/2008 |
| WO | 2011/015845 | 2/2011 |
| WO | 2013/096893 | 6/2013 |
| WO | 2018/125322 | 7/2018 |
| WO | 2018/186922 | 10/2018 |
| ZA | 2014/04758 | 8/2016 |

OTHER PUBLICATIONS

Paul C. Turner et al., Low Cost Titanium—Myth or Reality, www.osti.gov/scitech/servlets/purl/899609; 26 pages.

David S. Van Vuuren, Direct titanium powder production by metallothermic processes, Titanium Power Metallurgy, 2015, Elsevier Inc.

D.S. Van Vurren, A critical evaluation of processes to produce primary titanium, The Journal of the Southern Africa Institute of Mining and Metallurgy, Aug. 2009, vol. 109.

Zdunczyk, Mark J. et al.; 22. Quartz/Silica Sand; 1990; pp. 235-236; Society for Mining, Metallurgy, and Exploration (SME).

Goldman, Harold B.; 23. Sand and Gravel; 1990; pp. 237-241; Society for Mining, Metallurgy, and Exploration (SME).

Olsen, Richard H.; 24. Talc; 1990; pp. 242-245; Society for Mining, Metallurgy, and Exploration (SME).

25. Titanium; 1990; pp. 246-254; Society for Mining, Metallurgy, and Exploration (SME).

Freitas, Lino, R. et al.; "Aluminothermic Reduction of Anatase Concentrates;" INFACON 86 Proceedings (1986): 349-62, INFACON; International Ferro-Alloys Congress. Web. Nov. 3, 2015.

(56) References Cited

OTHER PUBLICATIONS

EPO, Supplementary European Search Report, EP 12859572, dated May 19, 2015; 2 pages; Europe.
EPO, Translation of RU2338805; May 10, 2008; 5 pages; Europe.
EPO, Translation of JP8225980; Aug. 3, 1996; 14 pages; Japan Energy Corp.
Korean Patent Office; PCT International Search Report, Issued in Connection to PCT/US2012/071467; dated Apr. 25, 2013; 4 pages; Korea.
Korean Patent Office; PCT Written Opinion of the International Searching Authority, Issued in Connection to PCT/US2012/071467; dated Apr. 25, 2013; 8 pages; Korea.
Giles, George; Crucible Furnaces; Morgan Molten Metal Systems; pp. 155-159; ASM International Handbook Committee. (2008; 2010). ASM Handbook, vol. 15—Castin—19.2 Furnace Types. ASM International.
Goa, Zhijiang et al.; Study on Preparing Ti6A14V Alloys From V-Ti Bearing Beach Placers; Energy Technology 2016: Carbon Dioxide Management and Other Technologies; 2016; pp. 117-124; China.
Achimovicova, M. et al.; Aluminothermic Production of Titanium Alloys (Part 1): Synthesis of TIO2 as Input Material; Association of Metallurgical Engineers of Serbia; Metall. Mater. Eng. Vol. 20 (2); 2014; pp. 141-154; Germany.
Dyas, Keith E.; Chapter 9: Quality and Specifications of Products; Society for Mining, Metallurgy, and Expoloration; 2002; pp. 174-193.
Kennedym, B.A.; Surface Mining, 2nd Edition—2.10.25.2 Distribution of Deposits; pp. 248-251; Society for Mining, Metallurgy, and Exploration (SME); 1990.
Lowrie, Raymond L.; SME Mining Reference Handbook—9.34 Tin; Society for Mining, Metallurgy, and Exploration (SME); 2002.
Zhang, Wensheng et al.; A Literature Review of Titanium Metallurgical Processes; 2011; 12 pages; Elsevier B.V.
Wang, L.L. et al.; Review, Thermite Reactions: Their Utilization in the Synthesis and Processing of Materials; 1993; pp. 3693-3708; Journal of Materials Science 28.; Chapman & Hall.
Mam, Ashraf M. et al.; Titanium Processing, Overview: Low Cost Titanium and Developing Applications; pp. 17-18; www.tms.org/jom.html.
Zheng, Haiyan et al.; Production of Titanium Powder Directly from Titanium Ore; 4 pages; Japan.
Zheng, Haiyan et al.; Production of Titanium Powder by the Calciothermic Reduction of Titanium Concentrates or Ore Using the Perform Reduction Process; Viewed 05/09/208; http://cat.inist.fr/?aModele=afficheN&cpsidt=19035891.
European Patent Office; Communication Pursuant to Article 94(3) EPC, Issued in connection to EP12859572.5; 4 pages; dated Oct. 19, 2017; Europe.
European Patent Office; PCT International Search Report, issued in connection to PCT/US2017/051399; dated May 25, 2018; 5 pages; Europe.
European Patent Office; PCT Written Opinion of the International Searching Authority, issued in connection to PCT/US2017/051399; dated May 25, 2018; 7 pages; Europe.
Fang, Zhigang Zak; Sintering of Advanced Materials—Fundamentals and Processes—13.2.1 Methods of Production and Powder Characteristics; Woodhead Publishing; 2010.
European Patent Office; PCT International Search Report, issued in connection to PCT/US2018/013813; dated Nov. 13, 2018; 4 pages; Europe.
European Patent Office; PCT Written Opinion of the International Searching Authority, issued in connection to PCT/US2018/013813; dated Nov. 13, 2018; 7 pages; Europe.
Australian Government; Examination Report No. 1 for Standard Patent Application, Issued in connection to AU2017279628; dated Oct. 23, 2018; 2 pages; Australia.
Search Report to corresponding Russian Application No. 2019125198 dated Jul. 2, 2021, 2 pages (2021).
Hoch, M.; Critical Review, Winning and Refining, 28 pages (1973).
Leone et al., Electrorefining of Titanium-Oxygen Alloys; RI ureau of Mines, Report of Investigations, 29 pages (1965).
Valvilova et al., Oxygen in Titanium Alloys with Aluminum, 4 pages (1975).
1 Office Action issued in corresponding JP Application No. 2019-538203 dated Dec. 16, 2021 (5 pages).
Cox et al., "Development of a Novel, Low-Cost Titanium Extraction Process for Bulk or Powder Applications," The Minerals, Metals & Materials Society, pp. 179-188 (2017).
Inzelt et al., "Handbook of Reference Electrodes," Springer, 351 pages (2013).

* cited by examiner

TITANIUM MASTER ALLOY FOR TITANIUM-ALUMINUM BASED ALLOYS

BACKGROUND OF THE DISCLOSURE

1. Related Applications

This application claims the benefit, and priority benefit, of U.S. patent application Ser. No. 15/872,328, filed Jan. 16, 2018, which claims the benefit of U.S. Provisional Patent Application Ser, No. 62/446,205, filed Jan. 13, 2017, the disclosure and contents of which are incorporated by reference herein in their entirety.

2. Field of the Invention

The present disclosure relates to a method to produce titanium master alloy for titanium-aluminum based metal alloys. The titanium-aluminum based alloys can have a composition of Ti-(1-10) wt. % Al—X (where X=V, Sn, Fe, Nb, Mo, etc.). More particularly the disclosure is directed towards various methods to electro-refine titanium aluminides for the production of titanium-(1-10) wt. % aluminum master alloy.

3. Description of the Related Art

Superior structural properties such as corrosion resistance, light weight and high-melting point, make titanium and its alloys the material of choice for many engineering applications.

However, the use of titanium and its alloys is limited due to high cost associated with their production. As of today, titanium alloys are produced from titanium "sponge", the product of a process known as the "Kroll Process". In subsequent steps, aluminum and other alloying metals must be added to the sponge by using various melting processes. Therefore, the cost of titanium alloys is several times higher than the original cost of titanium. For example, in one 2015 publication, titanium production cost is indicated to be $9.00/kg (Ma Qian and Francis H. Froes, ed., *Titanium Powder Metallurgy Science, Technology and Application* (Elsevier Inc., 2015), p. 37)) whereas the cost of Ti—Al—V is $17.00/kg.

Despite the cost of production, titanium and its alloys are the only choice for many engineering applications. 90% of titanium that is used in the aerospace industry is used as titanium alloys. Accordingly, there is a need for a new titanium alloy production process that reduces the cost significantly.

Fundamental theory teaches that Al, Mn, V, and Cr cannot be removed from Ti by electro-refining (Rosenberg et al. U.S. Pat. No. 6,309,595 B1). This is due to the similar electrical ionization potential of these elements. Literature demonstrates that indeed Mn, V, and Cr cannot be removed from Ti by electro-refining when present in substantial amounts (Dean et al. U.S. Pat. No. 2,913,378). Because the electrical ionization potential of Al is in between the potentials of Mn and V, it is clear that Al also theoretically cannot be removed by electro-refining. Therefore, literature dissuades from the use of Al-containing Ti as precursor material for electro-refining and advocates the removal of Al by other means prior to electro-refining (R. S. Dean et al. U.S. Pat. No. 2,909,473).

Moreover, literature teaches that the presence of a substantial amount of oxygen in the precursor material prevents the effective separation of Al from titanium. In fact, literature teaches that when 5% oxygen is present, aluminum cannot be separated by electro-refining (R. S. Dean et al. U.S. Pat. No. 2,909,473). Contrarily, the current embodiments of the disclosure require the presence of a substantial amount of oxygen (at least 10 wt. %) in materials to be electro-refined.

Also, literature teaches that it is essential to add soluble titanium to the electrolyte in the form of titanium chlorides when refining titanium (W. W. Gullet U.S. Pat. No. 2,817,631 and F. J. Schultz et al. U.S. Pat. No. 2,734,856). Titanium chlorides are produced by carbo-chlorination of highly purified $TiO_2$. Therefore, the use of these titanium chlorides adds more cost to the refining process.

Conventional titanium or titanium alloy production methods result in solid and dense products.

SUMMARY OF THE DISCLOSURE

With the present disclosure titanium-aluminum alloys (e.g. master alloys) can be produced directly without requiring any alloying steps (e.g. melting processes), therefore considerably decreasing the production cost compared to currently used methods.

In one or more embodiments of the instant disclosure, the methods provide a simple and more economical way to produce titanium-aluminum based alloys. With one or more embodiments of the instant disclosure, these methods do not require the addition of any soluble titanium (such as titanium chlorides) to the electrolyte, which thereby further reduces production cost. Also, the present disclosure provides for alloy products (e.g. Ti—Al master alloys) that are lightweight and "wool-like" or powdery products. The temperature and composition of the electrolyte bath appears to influence the physical form of the titanium-aluminum master alloy formed on the cathode. Temperatures in the range of 550-650° C. tend to result in a fine powdery texture, while temperatures in the range of 650-750° C. produce a product with a wool-like morphology, and temperatures in the range of 750-850° C. produce a crystalline product.

It is estimated in 2018 that embodiments of the present disclosure can produce titanium master alloy (Ti-(1-10)% Al) for $5-6.00/kg when considering today's manufacturing/market conditions.

Technology brought forth by embodiments described in the current disclosure provides a novel and straight-forward approach to produce titanium-aluminum alloys from titanium aluminides. This disclosure is an outgrowth of the patent application "System and Method for Extraction and Refining of Titanium", issued as U.S. Pat. No. 9,816,192 (Nov. 14, 2017) (hereinafter, "the UTRS Process"), which is incorporated herein by reference in its entirety. In some embodiments, the UTRS Process can be used in conjunction with one or more embodiments of the instant disclosure. However, it is noted that the embodiments of the present disclosure are also utilized as a stand-alone technology. One or more embodiments of the present disclosure provide a cost effective solution to the production of titanium-aluminum alloys that has heretofore not been appreciated.

In one aspect of the present disclosure, a method is provided for the production of titanium-aluminum based alloy products, including titanium master alloy products, directly from a variety of titanium bearing ores. One or more of the present methods significantly reduce the processing steps relative to traditional Ti—Al alloy production and result in reduced production costs.

In one aspect of the present disclosure, the method of refining titanium-aluminides provides: placing the titanium-aluminide precursor into a reaction vessel having an anode, a cathode, and an electrolyte, which may include halide salts of alkali metals or alkali-earth metals or a combination of both, and heating the reaction vessel to a temperature between 500 to 900° C. to create a molten mixture. An electric current is applied while maintaining an electrical differential between the anode and the cathode to deposit titanium master alloy on the cathode. When the refining process is complete, the current is terminated and the molten mixture is allowed to cool, and the refined titanium master alloy product is collected. This refined titanium master alloy product contains up to 10 wt. % Al (not more than 10 wt. % Al). Indeed, the refined master alloy resulting from the process can contain less than 5 wt. % or 2.5 wt. % Al or even less despite the substantial amount of aluminum present in the titanium aluminide starting material.

In one aspect of the present disclosure, the method of refining titanium-aluminides provides: placing the titanium-aluminide precursor into a reaction vessel, the reaction vessel configured with an anode, a cathode, and an electrolyte, which may include halide salts of alkali metals or alkali-earth metals or a combination of both; heating the electrolyte to a temperature sufficient to create a molten electrolyte mixture (e.g. 500° C. to 900° C.); directing an electrical current from the anode through the molten electrolyte mixture to the cathode; and oxidizing the titanium-aluminide precursor from the anode (or dissolved in ionic form in the molten electrolyte mixture) to form a Ti—Al master alloy at the cathode.

In some embodiments, the Ti—Al master alloy contains up to 10 wt. % Al.

In some embodiments, the reducing step further comprises depositing the Ti—Al master alloy onto a surface of the cathode.

In some embodiments, directing an electrical current comprises maintaining an electrical differential between the anode and the cathode.

In some embodiments, the anode is configured to contact and electrically communicate with the electrolyte.

In some embodiments, the cathode is configured to contact and electrically communicate with the electrolyte.

In some embodiments, the anode is positioned in the reaction vessel at a distance from the cathode to prevent electrical shorting of the cell (the anode-cathode distance is variable, but always >0).

In some embodiments, the method comprises terminating the electrical current and turning off the furnace, thereby allowing cooling of the molten electrolyte mixture (e.g. solidifying the electrolyte).

In some embodiments, the Ti—Al master alloy is recovered from the cell prior to solidification (e.g. tapping, draining, withdrawal of the cathode while the bath is cooling but not solidified, or a combination thereof).

The anode is in the form of a non-consumable mesh container that holds the titanium-aluminum-oxygen precursor during the refining process. The position of the anode is adjustable; the distance between the anode and the cathode is between 1 and 6 cm.

The titanium aluminides to be electro-refined may be obtained by reducing titanium-bearing ores with aluminum (e.g., by using the UTRS Process) or by melting titanium and aluminum scrap metal under oxidizing conditions to produce a product that contains 10 to 25 wt. % Al and at least 10 wt. % oxygen.

In one aspect of the present disclosure, the method for electro-refining titanium-aluminides to produce titanium master alloys provides: placing titanium-aluminide comprising more than ten weight percent aluminum, and at least ten weight percent oxygen, into a reaction vessel, the reaction vessel configured with an anode, a cathode, and an electrolyte, the electrolyte including halide salts of alkali metals or alkali-earth metals or a combination thereof; heating the electrolyte to a temperature of 500° C.-900° C. sufficient to create a molten electrolyte mixture; directing an electrical current from the anode through the molten electrolyte mixture to the cathode; and dissolving the titanium-aluminide from the anode to deposit a titanium-aluminum master alloy at the cathode.

In some embodiments, the anode includes a non-consumable mesh container in which the titanium aluminide is placed, the titanium aluminide being consumable during the refining process.

In some embodiments, the titanium-aluminide comprises 10%-25% aluminum and at least 10% oxygen by weight.

In some embodiments, the titanium-aluminide comprises 15%-25% aluminum and at least 10% oxygen by weight.

In some embodiments, the titanium-aluminide comprises 20%-25% aluminum and at least 10% oxygen by weight.

In some embodiments, the titanium aluminum master alloy comprises about 99.0% titanium and about 1.0% aluminum by weight.

In some embodiments, the titanium aluminum master alloy comprises about 98.0% titanium and about 2.0% aluminum by weight.

In some embodiments, the titanium aluminum master alloy comprises about 97.0% titanium and about 3.0% aluminum by weight.

In some embodiments, the titanium aluminum master alloy comprises about 96.0% titanium and about 4.0% aluminum by weight.

In some embodiments, the titanium aluminum master alloy comprises about 95.0% titanium and about 5.0% aluminum by weight.

In some embodiments, the titanium aluminum master alloy comprises about 94.0% titanium and about 6.0% aluminum by weight.

In some embodiments, the titanium aluminum master alloy comprises about 93.0% titanium and about 7.0% aluminum by weight.

In some embodiments, the titanium aluminum master alloy comprises about 92.0% titanium and about 8.0% aluminum by weight.

In some embodiments, the titanium aluminum master alloy comprises about 91.0% titanium and about 9.0% aluminum by weight.

In some embodiments, the titanium aluminum master alloy comprises about 90.0% titanium and about 10.0% aluminum by weight.

In some embodiments, the electrolyte is substantially free of added titanium chlorides.

In some embodiments, the electrolyte is substantially free of added forms of soluble titanium.

In some embodiments, the temperature range is between 550° C. and 650° C. and the titanium master alloy product is a powder.

In some embodiments, the temperature range is between 650° C. and 750° C. and the titanium master alloy product is wool-like.

In some embodiments, the temperature range is between 750° C. and 850° C. and the titanium master alloy product is crystalline.

In some embodiments, the electrical current density of the cathode is between 0.01 $A/cm^2$ and 0.05 $A/cm^2$.

In some embodiments, the electrical current density of the cathode is between 0.05 A/cm$^2$ and 0.1 A/cm$^2$.

In some embodiments, the electrical current density of the cathode is between 0.1 A/cm$^2$ and 0.5 A/cm$^2$.

In some embodiments, the electrical current density of the cathode is between 0.5 A/cm$^2$ and 1.0 A/cm$^2$.

In some embodiments, a reference electrode is used to monitor electrical differentials wherein the electrical differential between the anode and the reference electrode is 0.2V-0.4V.

In some embodiments, a reference electrode is used to monitor electrical differentials wherein the electrical differential between the anode and the reference electrode is 0.4V-0.6V.

In some embodiments, a reference electrode is used to monitor electrical differentials wherein the electrical differential between the anode and the reference electrode is 0.6V-0.8V.

In some embodiments, the electrical differential between the anode and the cathode is 0.4V-0.8V.

In some embodiments, the electrical differential between the anode and the cathode is 0.8V-1.2V.

In some embodiments, the electrical differential between the anode and the cathode is 1.2V-1.6V.

In some embodiments, the electrical differential between the anode and the cathode is 1.6V-2.0V.

In some embodiments, the distance between the anode and the cathode is adjusted to prevent short circuiting of the current flow through the electrolyte between the anode and the cathode.

In some embodiments, the distance between the anode and the cathode is 2.0 cm-4.0 cm.

In some embodiments, the distance between the anode and the cathode is 4.0 cm-6.0 cm.

In one aspect of the present disclosure, the method for refining titanium aluminides into master titanium-aluminum alloys provides: placing a titanium aluminide comprising more than ten weight percent aluminum, and at least ten weight percent oxygen, into a reaction vessel, the reaction vessel configured with an anode, a cathode, and an electrolyte, the electrolyte including halide salts of alkali metals or alkali-earth metals or a combination of both; heating the electrolyte to a temperature sufficient to create a molten electrolyte mixture; directing an electrical current from the anode through the molten electrolyte mixture to the cathode; and dissolving the titanium aluminide from the anode to deposit a titanium-aluminum master alloy at the cathode, said master alloy containing up to 10 wt. % aluminum.

In some embodiments, the electrolyte is substantially free of added titanium chlorides or other added forms of soluble titanium.

In some embodiments, after the dissolution and deposition step, the electrolyte is allowed to cool and the titanium-aluminum master alloy is recovered from the reaction vessel prior to solidification of the electrolyte.

In some embodiments, the titanium-aluminum master alloy contains 2.5 wt. % or less aluminum.

DETAILED DESCRIPTION

Reference will now be made in detail to the various embodiments of the present disclosure. The embodiments are described below to provide a more complete understanding of the components, processes and apparatuses of the present disclosure. Any examples given are intended to be illustrative, and not restrictive.

One embodiment of the present disclosure provides a method for the refining of titanium-aluminide products from titanium-bearing ores.

In the present disclosure, refining of the titanium-aluminide products is done via electrochemical refining. A titanium-aluminide product is placed in a reaction vessel having a cathode and an anode. The anode is embodied as a movable perforated basket/container made from quartz or metals that are more noble than titanium (e.g. nickel or iron) to hold the titanium aluminide to be refined. The cathode is at or near the bottom of the reaction vessel, with the anode suspended above the cathode. Having the ability to adjust the distance between the cathode and the anode provides a means of maintaining an optimum distance between the cathode and the anode throughout the refining operation. This optimum distance ranges between 1 and 6 cm. The electrical differential between the anode and the cathode is between 0.4 and 2.0 volts, and the cathode current density is between 0.01 and 1 A/cm$^2$. During the refining process, master alloy is deposited on the cathode as dendrites. Growth of the dendrites throughout the process decreases the distance between the cathode and the anode. Thus, some adjustment in distance may be necessary to maintain current density and to avoid short circuiting the current flow. Without adjusting the anode-cathode distance throughout the process, the dendrites could touch the anode which would produce an electrical short-circuit.

The reaction vessel also holds an electrolyte capable of transporting titanium and aluminum ions. This electrolyte is placed in the reaction vessel and heated to subject the titanium-aluminum product to an electro-refining process. The electrolyte used during the refining operation may be a mixture of $MgCl_2$—NaCl—suitable for a temperature range of 550° C.-650° C., KCl—NaCl—suitable for a temperature range of 650° C. to 750° C., or NaCl—suitable for a temperature range of 750° C.-850° C. The refining operation is performed under an inert atmosphere. A resistive element furnace or an induction furnace can be used to heat the electrolyte. In the present disclosure, both types of furnaces (resistive element and induction) have been used. When using an induction furnace, a molybdenum susceptor crucible was used to couple with the induction field in order to generate heat that was transmitted to the electrolyte blend. The perforated basket holding the titanium aluminides to be refined is used as the anode in the electronic circuit by connecting a lead to the positive (+) side of an electric power supply. Metal foil can be placed around the inside of the reaction vessel and used as the cathode by connecting it to the negative (−) side of the electric power supply. During operation, the titanium-aluminide is oxidized (ionized) and titanium and aluminum ions migrate to the cathode where they are reduced to form titanium master alloy crystals or a wool layer of the refined titanium-aluminum alloy product. Impurities are concentrated (left behind) in the anode basket or remain in the molten electrolyte.

Alternatively, a cathode in the form of a metal plate can be placed parallel to the bottom of the reaction vessel with the anode basket suspended above the plate. In this configuration, the optimum distance between the cathode plate and the anode basket can be maintained by moving the anode basket vertically throughout the refining operation. The cathode is connected to the negative (−) side of the power supply by the lead and the anode is connected to the positive (+) side of the power supply. The cathode to anode distance is between 2 cm and 6 cm. Other configurations for the electro-purification cell are possible as well.

Titanium-aluminides to be electro-refined can be produced by reducing titanium bearing ores with Al (e.g., by using the UTRS Process). $TiO_2$ content in titanium bearing ore can be anywhere between 75-98% by weight. Desired composition of titanium-aluminide can be achieved by varying the $TiO_2$: Al ratio. As an example, mixing 559 g of a Rutile ore (~94% $TiO_2$ content) with 232 g of Al powder and 455 g of $CaF_2$ will produce an acceptable blend. Charging the blend into a graphite vessel, ramping the temperature at 10° C./min. (in an argon atmosphere) to ~1725° C. and soaking for ~15 min. will produce suitable titanium aluminide metal that can be used as feed for the electro-refining process described herein.

Titanium-aluminides to be electro-refined can also be produced by melting titanium and aluminum scrap metals according to appropriate ratios.

Samples produced from the following examples were analyzed by using Atomic Emission Spectroscopy—Direct Current Plasma (DCP—OES) for analyzing metal concentrations and Inert Gas Fusion (IGF) for analyzing oxygen concentrations. Instruments were calibrated by using NIST standards. With reference to the following Examples, the cathode deposit refers to the master alloy produced via the various methods, as outlined in each Example. The percentages of various components are in weight percent. Unless otherwise specified, the cathode deposit (alloy product) refers to a wt. % Aluminum, the balance being Titanium and if present, any unavoidable impurities.

Example 1. Titanium-aluminide used in this example was produced by melting appropriate amounts of titanium and aluminum to produce Ti-36% Al alloy. Oxygen content of this alloy was 0.2%. The alloy was cut into small pieces and 29.0 g of this material was electro-refined at a constant DC current of 1.0 A. The refining process was carried out in NaCl—KCl (44:56 wt. %) electrolyte at 750° C. Nine grams (9.0 g) of cathode deposit was harvested and contained 33 wt. % Al.

Example 2. Titanium-aluminide used in this example was produced by melting appropriate amounts of titanium and aluminum to produce a Ti-10% Al alloy. Oxygen content of this alloy was 0.2%. The alloy was cut into small pieces and 31.0 g of this material was electro-refined at a constant DC current of 1.0 A. The refining process was carried out in NaCl—KCl (44:56 wt. %) electrolyte at 750° C. 14.0 g of cathode deposit was harvested and contained 7.0% Al.

Example 3. Titanium-aluminide used in this example was produced by aluminothermic reduction of $TiO_2$ with Al to produce a Ti-13% Al-11% O alloy. The alloy was broken into small pieces and 31.0 g of this material was electro-refined at a constant DC current of 1.0 A. The refining process was carried out in NaCl—KCl (44:56 wt. %) electrolyte at 750° C. 18.0 g of cathode deposit was harvested and contained 2.5% Al.

Example 4. Titanium-aluminide used in this example was produced by aluminothermic reduction of $TiO_2$ to produce a Ti-10% Al-13% O alloy. The alloy was broken into small pieces and 276.0 g of this material was electro-refined at a constant DC current of 6.0 A. The refining process was carried out in NaCl—KCl (44:56 wt. %) electrolyte at 750° C. 96.0 g of cathode deposit was harvested and contained 1.1% Al.

Example 5. Titanium-aluminide used in this example was produced by aluminothermic reduction of $TiO_2$ to produce Ti-13% Al-11% O alloy. The alloy was broken into small pieces and 70.0 g of this material was electro-refined at a constant voltage of 0.8V. The voltage of the anode was controlled by using a titanium rod as pseudo-reference electrode. The refining process was carried out in NaCl—KCl (44:56 wt. %) electrolyte at 750° C. 25.0 g of cathode deposit was harvested and contained 2.8% Al.

Example 6. Titanium-aluminide used in this example was produced by aluminothermic reduction of $TiO_2$ to produce Ti-15% Al alloy and electro-refined to produce a Ti-13% Al-0.7% O alloy. This alloy had wool-like morphology. The alloy was pressed into small pieces and 40.0 g of this material was electro-refined a second time at a constant voltage of 0.8V. The voltage of the anode was controlled by using a titanium rod as pseudo-reference electrode. The refining process was carried out in NaCl—KCl (44:56 wt. %) electrolyte at 750° C. 30.0 g of cathode deposit was harvested and contained 7.5% Al.

Example 7. Titanium-aluminide used in this example was produced by melting appropriate amounts of titanium, aluminum and iron to produce Ti-10% Al-48% Fe alloy. The alloy was cut into small pieces and 29.0 g of this material was electro-refined at a constant DC current of 1.0 A. The refining process was carried out in NaCl—KCl (44:56 wt. %) electrolyte at 750° C. 9.0 g of cathode deposit was harvested and contained 17% Al and 1.6% Fe.

Example 8. Titanium-aluminide with a composition of Ti-10% Al-12% O was electro-refined to obtain the composition of Ti-2.7% Al-1.1% O. The refined material was then once again electro-refined to obtain final product with 99.0% of Ti.

Current efficiency for the electro-refining process depends on the size of titanium-aluminide pieces. A current efficiency of 80% is achieved for the process when less than 4.0 mm pieces were used. Current efficiency is estimated as a percentage of actually harvested yield to theoretically expected yield. Theoretically expected yield is proportional to total amount of coulombs passed through the system.

Examples 3, 4, 5, and 8 demonstrate that if the precursor material contains more than 10% oxygen, a very good separation of titanium and aluminum can be achieved during the electro-refining process. The titanium master alloy products in these examples illustrate that more than 78% of the aluminum in the initial precursor material was removed. In contrast, Examples 1, 2 and 6 demonstrate that not more than 42% of the aluminum contained in the precursor material can be removed during electro-refining without the presence of a substantial amount of oxygen.

After the refining operation, the resulting refined titanium master alloy product can be further processed into a final alloy product by adding additional elements. For example, the resulting refined titanium master alloy can be ground or milled with vanadium and converted into Ti—Al—V powder.

Example 9. 56.4 g of Ti-4.6% Al master alloy mixed with 2.8 g of V—Al alloy, 0.55 g Al and melted in VAR. Resulting final alloy had a composition of Ti-6.3Al-3.8V.

The refining operation produces a refined titanium master alloy product with a finely structured, dendritic morphology. For example, the titanium master alloy product may comprise titanium crystallites that have deposited on the cathode during the electro-refining operation. The fine dendritic structure of the titanium master alloy product uniquely provides a pathway for near-net shaped parts through hydraulic compression and subsequent sintering without the aid of a binding agent. Surface area in the refined titanium-aluminum alloy product ranged between 0.1 $m^2/g$ and 2.5 $m^2/g$.

Due to the small size and delicate nature of the refined titanium master alloy product, near-net-shaped products can be compressed for further processing. The dendritic form of the refined titanium master alloy product (titanium master alloy wool) can be compressed by using hydraulic pressure. To accomplish this, the titanium master alloy wool is placed into a compression mold of desired shape. The mold is then placed into a hydraulic press where, between 35 to 65 tons/in$^2$ is applied. This procedure can produce near-net shaped titanium parts that can then be sintered, used as consumable electrodes in a vacuum arc remelt (VAR) process, melted or further processed depending on the product application.

While specific embodiments of the disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosure which is to be given the full breadth of the appended claims and any and all equivalents thereof.

What is claimed is:

1. A process for electro-refining titanium-aluminide to produce titanium-aluminum master alloys, comprising:

a. placing titanium-aluminide comprising more than ten weight percent aluminum, and at least ten weight percent oxygen, into a reaction vessel, the reaction vessel configured with an anode, a cathode, and an electrolyte, the electrolyte including halide salts of alkali metals or alkali-earth metals or a combination thereof;

b. heating the electrolyte to a temperature of 500° C.-900° C. sufficient to create a molten electrolyte mixture;

c. directing an electrical current from the anode through the molten electrolyte mixture to the cathode;

d. monitoring an electrical differential between the anode and a reference electrode during the directing step, wherein the electrical differential is maintained between 0.2V-0.8V; and e. dissolving the titanium-aluminide from the anode to deposit a titanium-aluminum master alloy at the cathode;

wherein the titanium-aluminum master alloy contains less than 5.0 wt % aluminum.

2. The process of claim 1 wherein the titanium-aluminide comprises 10%-25% aluminum and at least 10% oxygen by weight.

3. The process of claim 1 wherein the temperature range in the heating step is between 550° C. and 650° C. and the titanium master alloy product is a powder.

4. The process of claim 1 wherein the temperature range in the heating step is between 650° C. and 750° C. and the titanium master alloy product is wool-like.

5. The process of claim 1 wherein the temperature range in the heating step is between 750° C. and 850° C. and the titanium master alloy product is crystalline.

6. The process of claim 1 wherein the electrical current density of the cathode is between 0.01 A/cm$^2$ and 1.0 A/cm$^2$.

7. The process of claim 1 wherein the electrical differential between the anode and the cathode is 0.4V-2.0V.

8. The process of claim 1 comprising the further step of adjusting the distance between the anode and the cathode to prevent short circuiting of the current flow through the electrolyte between the anode and the cathode.

9. The process of claim 1 wherein the distance between the anode and the cathode is 2.0 cm-6.0 cm.

10. The method of claim 1 wherein the electrolyte is substantially free of added titanium chlorides or other added forms of soluble titanium.

11. The method of claim 1 wherein the titanium-aluminum master alloy contains 2.5 wt. % or less aluminum.

* * * * *